US005568231A

United States Patent [19]

Asano et al.

[11] Patent Number: 5,568,231

[45] Date of Patent: Oct. 22, 1996

[54] CHARGING DEVICE FOR CHARGING THE SURFACE OF A PHOTOSENSITIVE MEMBER IN AN ELECTROPHOTOGRAPHIC IMAGE FORMING DEVICE

[75] Inventors: Masaki Asano, Amagasaki; Shuji Iino, Hirakata; Akihito Ikegawa, Sakai; Izumi Osawa, Ikeda, all of Japan

[73] Assignee: Minolta Camera Kabushiki Kaisha, Osaka, Japan

[21] Appl. No.: 61,166

[22] Filed: May 13, 1993

[30] Foreign Application Priority Data

May 15, 1992 [JP] Japan ..... 4-123411

[51] Int. Cl.[6] ..... G03G 15/02

[52] U.S. Cl. ..... 355/219; 361/225

[58] Field of Search ..... 355/219, 225, 355/246, 271, 274, 277, 208; 361/225, 235, 221

[56] References Cited

U.S. PATENT DOCUMENTS

| | | | |
|---|---|---|---|
| 3,935,517 | 1/1976 | O'Brien | 317/262 |
| 4,383,752 | 5/1983 | Kisler . | |
| 4,777,554 | 10/1988 | Gokita | 361/91 |
| 4,962,307 | 10/1990 | Nakaya | 250/324 |
| 5,012,282 | 4/1991 | Wanou et al. | 355/219 |
| 5,105,330 | 4/1992 | Hiwada | 361/225 |
| 5,144,368 | 9/1992 | Ohzeki et al. | 355/219 |
| 5,179,397 | 1/1993 | Ohzeki et al. | 346/160 |
| 5,305,177 | 4/1994 | Aoki et al. | 361/225 |

FOREIGN PATENT DOCUMENTS

| | | |
|---|---|---|
| 56-35159 | 4/1981 | Japan . |
| 56-132356 | 10/1981 | Japan . |

*Primary Examiner*—Thu Anh Dang
*Attorney, Agent, or Firm*—Brinks Hofer Gilson & Lione

[57] ABSTRACT

A charging device including a charging member which is in contact with or minutely spaced from a surface of a photosensitive member, device for applying a constant voltage to the charging member, and a controller for controlling the voltage applied to the charging member when a current flowing from the charging member to the surface of the photosensitive member exceeds a predetermined value.

19 Claims, 5 Drawing Sheets

CHARGING DEVICE FOR CHARGING THE SURFACE OF A PHOTOSENSITIVE MEMBER IN AN ELECTROPHOTOGRAPHIC IMAGE FORMING DEVICE

BACKGROUND OF THE INVENTION

1. Field of the Invention

The present invention relates to charging devices used in electrophotographic image forming devices such as copying machines and printers for electrically charging surfaces of electrostatic latent image support members.

2. Description of the Related Art

There have been proposed charging devices of a type in which a surface of a photosensitive member, i.e., electrostatic latent image supporting member is charged by applying a voltage to a charging member such as a brush, roller or rotary endless belt which is in contact with or minutely spaced from the surface of the photosensitive member. Such charging devices have attracted the attention in view of the fact that they generates extremely small amount of ozone, which adversely affects surfaces of photosensitive members and human bodies, compared with corona charging devices.

However, pinholes or the similar defects in which the photosensitive layer is lost are likely to generate in the surface of the photosensitive member for the electrophotographic processing during the manufacturing process. In the charging device in which the charging member subjected to the high voltage directly contacts the surface of the photosensitive member or is faced thereto with a minute space as described above, the charging member and a substrate of the photosensitive member may be short-circuited through the portion not bearing the photosensitive layer. When short-circuited, the charging member is heated and may burn, resulting in the spread of fire to portions of the charging member other than the short-circuited portion in the extreme case. The burning generates unpleasant smoke, and the spread of fire impairs and renders the charging member inoperable, resulting in an extremely dangerous state.

In order to solve this problem, for example, U.S. Pat. No. 5,012,282 has disclosed a contact charging device in which a constant-current power supply is connected to a brush charging device, and a constant current is supplied to a photosensitive member through a brush formed of electrically conductive fibers. The constant current power supply can prevents the flow of an overcurrent to the charging member of the charging device even if the charging member encounters with the pinhole in the photosensitive member, and thus can prevent the burning or the like thereof. This can be achieved by the fact that, as shown in FIG. 9, the current i is constant regardless of variation of the load, i.e., existence and nonexistence of pinholes A, B, C, D as well as relative sizes thereof (e.g., A<B<C<D). However, the applied charging voltage (a predetermined value is −1.2 kV in the illustrated example) varies in accordance with variation of load, so that charged potentials on the surface of the photosensitive member disadvantageously becomes irregular.

In practice, the load also changes due to history (residual potential) of the photosensitive member and irregularity of a photosensitive layer thickness of the photosensitive member. All kinds of variation of the load affects the image.

SUMMARY OF THE INVENTION

The inventors of the application have studied the burning of charging member in various ways, and have found that whether the charging member burns or not does not depend on the size of the pinholes and the relative speeds of the photosensitive member and the charging member but depends on discharge intensity of the spark discharge, i.e., a value of current supplied from the power supply to the charging member. Based on this, the present invention has been completed.

A major object of the invention is to provide a charging device in which generation of an excessively abnormal current can be prevented even if pinholes or the like exist in a surface of a photosensitive member, and thereby inflammation and spread of fire of a charging member can be prevented.

Another object of the invention is to provide a charging device which can charge the surface of the photosensitive member to have a uniform potential.

In order to achieve the foregoing objects, the present invention provides a charging device including charging means having a charging member which is in contact with or minutely spaced from a surface of a photosensitive member, means for applying a constant voltage to the charging means, and control means for controlling the voltage applied to the charging means when a current flowing from the charging means to the surface of the photosensitive member exceeds a predetermined value.

According to the charging device of the invention, even if the current flowing to the charging member changes due to the fact that the charging member encounters with a defect such as a pinhole in the surface of the photosensitive member, the charging device maintains the driving state and the constant voltage is supplied to the charging member in the case where the current value does not reach a preset reference value (upper limit), i.e., there is not fear of inflammation or the like of the charging member. Meanwhile, if the current value reaches or exceeds the upper limit, the voltage supplied to the charging member is controlled for preventing inflammation of the charging member and spread of fire.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENT

Figure 1:
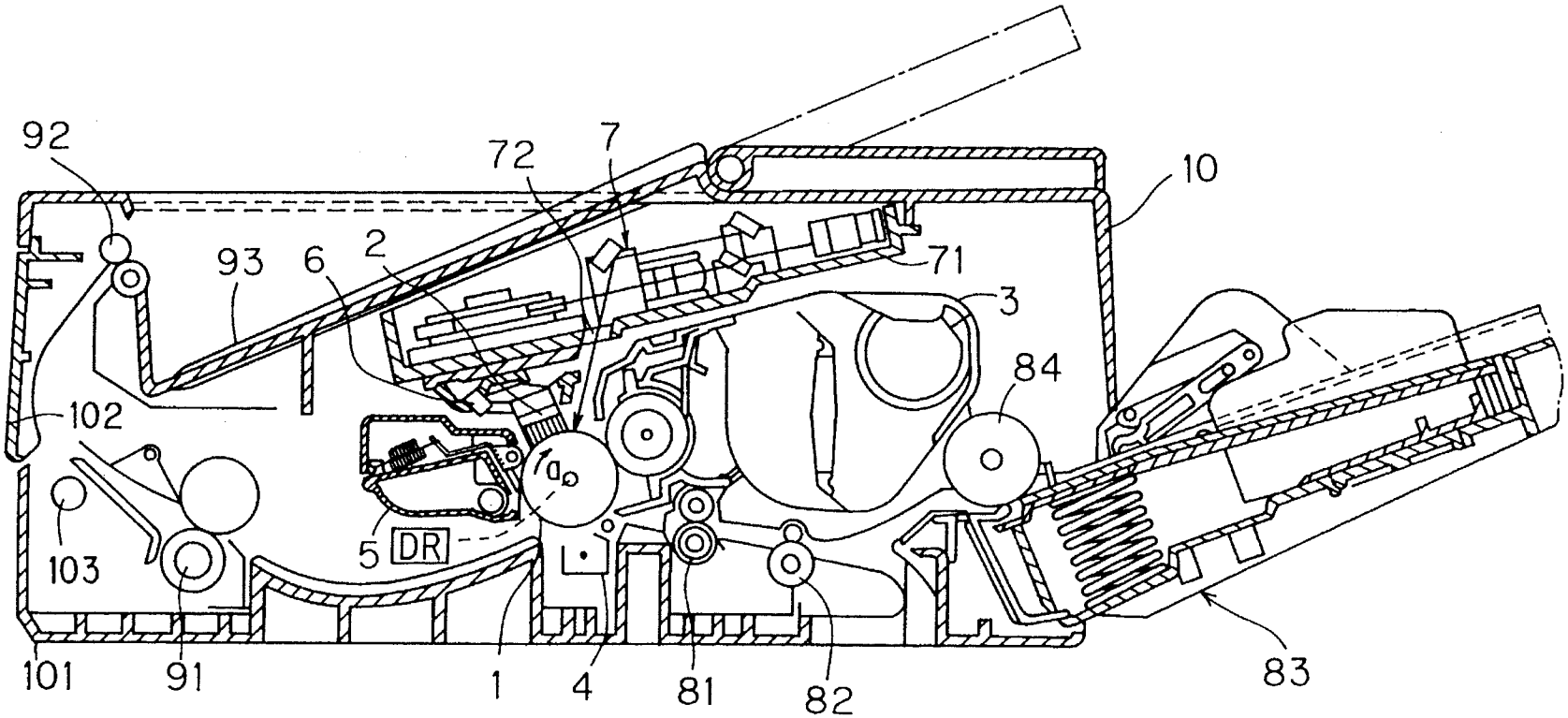
FIG. 1 shows a schematic structure of an image forming apparatus into which a charging device of an embodiment of the invention is assembled.

FIG. 1 shows a schematic structure of an image forming apparatus into which a charging device of an embodiment of the invention is assembled.

The image forming apparatus shown in FIG. 1 is provided at its central portion with a photosensitive drum 1, i.e., an electrostatic latent image support member, which is driven to rotate by a drive DR including an electric motor at a predetermined speed in a direction indicated by an arrow a. Around the drum 1, there are disposed a charging device 2, a developing device 3, a transfer charger 4, a cleaning device 5 and an eraser 6 which are aligned in this order.

An optical system 7 is arranged above the photosensitive drum 1. The optical system has a housing 71 accommodating various components and devices such as a semiconductor laser generating device, polygon mirror, toroidal lens, half mirror, spheric mirror, return mirror and reflection mirror. The housing 71 is provided at its floor with an exposure slit 72. An image exposure is applied through the exposure slit and a space between the charging device 2 and the developing device 3 to the photosensitive drum 1.

At the right of the photosensitive drum 1 in the figure, there are sequentially disposed a timing roller pair 81, an intermediate roller pair 82 and a sheet feeder cassette 83, with which a sheet feed roller 84 confronts. At the left of the photosensitive drum 1 in the figure, there are sequentially disposed a fixing roller pair 91 and a sheet discharge roller pair 92, with which a sheet discharge tray 93 confronts.

The parts and portions described above are mounted on a main body 10 of the printer. The main body 10 is formed of lower and upper units 101 and 102. The upper unit 102 carries the charging device 2, developing device 3, cleaning device 5, eraser 6, optical system 7, upper roller of the timing roller pair 81, upper roller of the intermediate roller pair 82, feed roller 84, upper roller of the fixing roller pair 91, discharge roller pair 92 and sheet discharge tray 93. The upper unit is pivotable around a shaft 103 disposed at the left end portion of the printer so that the end at the sheet feeding side of this unit may be upwardly opened for the restoration from the jamming state and various kinds of maintenance.

In this printer, the surface of the photosensitive drum 1 is charged by the charging device 2 to have a uniformly charged area of a predetermined potential, which will be changed into an electrostatic latent image by an image exposure applied by the optical system 7. The electrostatic latent image thus formed is developed by the developing device 3 into a toner image, which moves to a transfer region confronting with the transfer charger 4.

Meanwhile, a transfer sheet of paper is drawn from the feed cassette 83 by the feed roller 84. The sheet is moved through the intermediate roller pair 82 to the timing roller pair 81, from which the sheet is fed into the transfer region in synchronization with the toner image on the drum 1. In this manner, the toner image on the drum 1 is transferred onto the transfer sheet at the transfer region by the operation of the transfer charger 4. Then, the transfer sheet is fed to the fixing roller pair 91, at which the toner image is fixed. Then, the sheet is discharged into the discharge tray 93 by the discharge roller pair 92.

After the transfer of the toner image onto the transfer sheet, residual toner on the photosensitive drum 1 is cleaned up by the cleaning device 5, and residual charge is erased by the eraser 6.

A system speed of the printer, i.e., a peripheral speed of the photosensitive drum 1 is 3.5 cm/sec., and the developing device 3 is a contact developing device using one-component developer and carrying out reversal development.

The photosensitive drum 1 having an outer diameter of 30 mm is an organic photosensitive member of a functionally separated type for negative charging, which has a sensitivity to long wave light, and is manufactured by sequentially forming a charge generating layer containing phthalocyanine and a charge transmitting layer containing hydrazone on a cylindrical substrate of aluminium.

The toner used in the developing device 3 is of a negatively chargeable type and contains polyester. The toner is accommodated in the developing device 3, and the development is carried out under a developing bias of −300 V.

Figure 2:
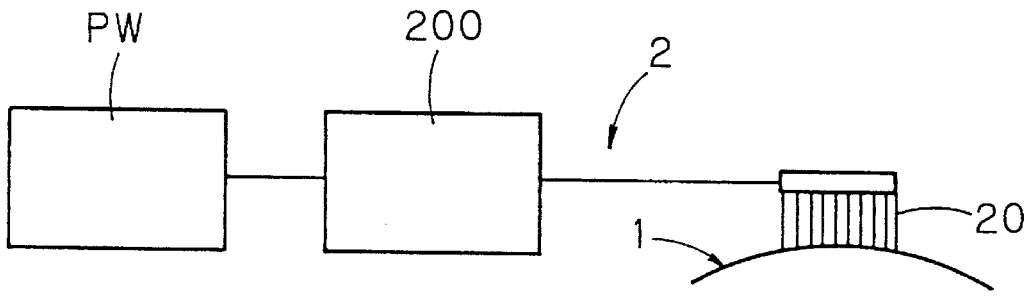
FIG. 2 is a block diagram of a voltage supply circuit of a charging device of the invention.
Figure 3A:
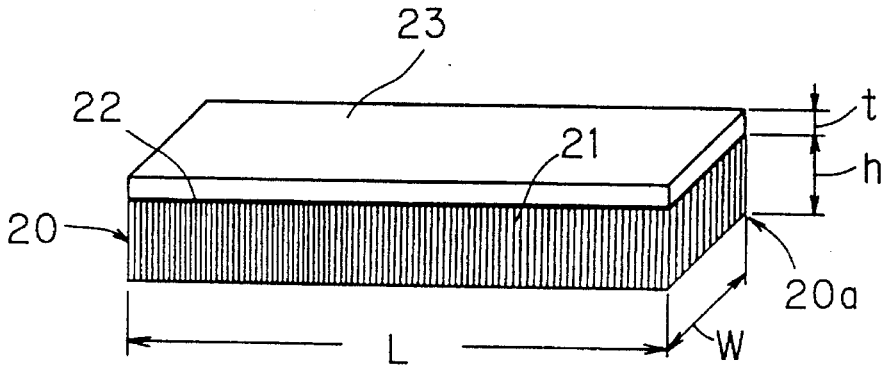
FIG. 3(A) is a perspective view showing a basic structure of a brush charging device of an embodiment of the invention.

The charging device 2 of the invention is formed of, for example as shown in FIG. 2, a charging member 20, a constant voltage power supply PW connected to the charging member 20 through a current upper limiter 200 for controlling the current flowing to the charging member. FIG. 3(A) is a perspective view showing a basic structure of a charging brush **20*a* used as the charging member 20**.

Figure 3B:
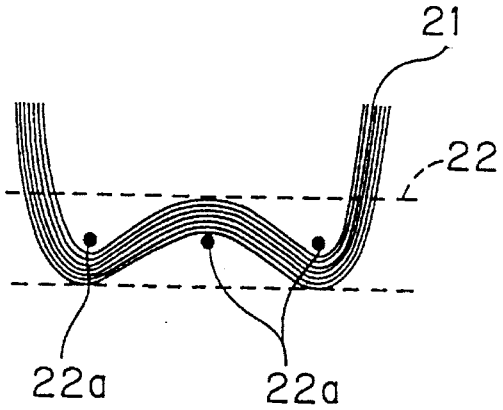
FIG. 3(B) shows a structure of a pile cloth including electrically conductive fibers woven thereinto in a device shown in FIG. 3(A)

The charging brush **20*a* is formed of an electrically conductive substrate 23 of aluminium having a thickness t of 1.0 mm, and a belt-like sheet or strip of pile cloth 22 provided over the substrate 23, as shown in FIGS. 3(A) and 3(B). The pile cloth is formed as follows. Brush hairs 21, which are grouped into bundles, each including about 100 hairs are woven in a W-form with warps 22*a* of the base cloth 22 at a density of 150 hairs/mm$^2$, and the rear surface of the base cloth 22 is coated with electrically conductive adhesive. The brush hair 21** is made of a conductive rayon fiber of 6 deniers, which has an electrical resistivity of about $1\times10^6$ Ωcm and contains conductive carbon powder at 18 wt. %. The brush has a length L of 240 mm, a width of 8 mm and a height h of 5 mm.

The brush hairs 21 are connected to the constant voltage power supply PW through the substrate 23 and current upper limiter 200, and are pressed onto the surface of the photosensitive drum 1 so that almost all the brush hairs are in contact with the surface of the photosensitive drum 1. In this state, the constant voltage power supply PW applies the voltage thereto to charge the drum surface.

Figure 4:
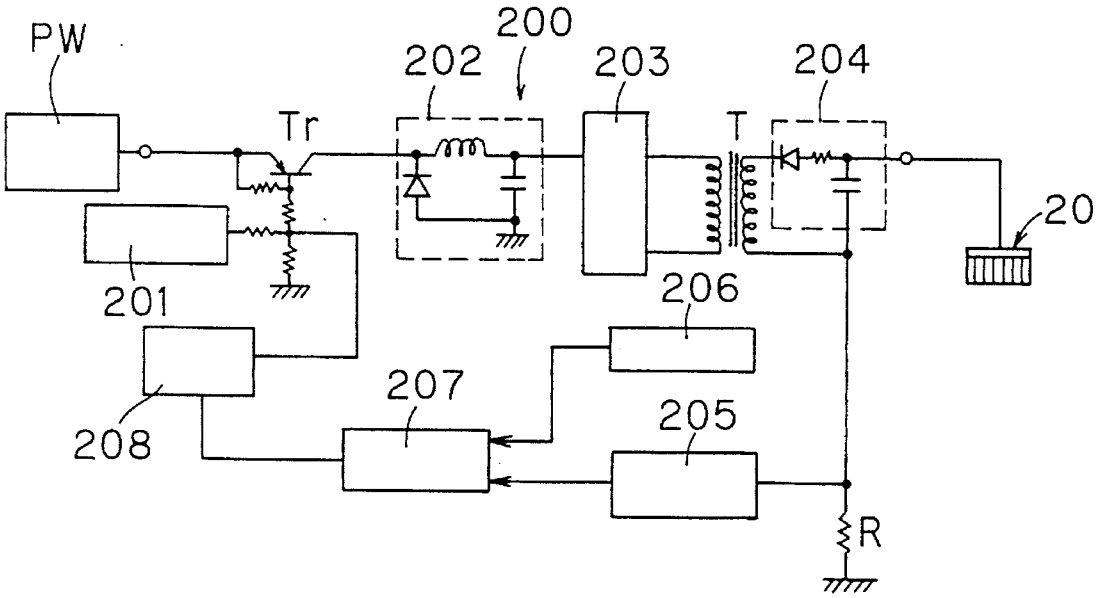
FIG. 4 is a circuit diagram of an example of a current upper limiter.

The current upper limiter 200 may have such a structure that it drops the voltage applied to the charging member 20 to 0 V when the value of current flowing from the charging member 20 to the photosensitive drum 1 reaches the predetermined value, or that it drops the voltage so as to lower the current correspondingly to an excessive value by which the current value has exceeded or tends to exceed the predetermined value. More specifically, it may have a circuit structure shown in FIG. 4. In the case where the charging member 20 is spaced from the surface of the photosensitive drum 1, the space is preferably 1500 μm or less, and more preferably 1000 μm or less.

The limiter 200 will be described below. The constant voltage power supply PW ( of −1.2 KV in the illustrated embodiment) supplies the voltage to a signal generating circuit 203 through a transistor Tr, of which On-Off control is carried out at a predetermined timing by control signals supplied from an output controller 201, and a ripple filter 202. An output of a signal generating circuit 203 is applied to a primary side of a step-up transformer T for generating an AC high voltage at a secondary side thereof. This high voltage is converted into a DC high voltage by a rectifying and smoothing circuit 204 including a diode and a capacitor, and is supplied to a load, i.e., the charging brush 20. Meanwhile, the current flowing to the load is converted by a resistor R into a voltage, which is supplied to an abnormal current detector 205. When the brush hairs 21 of the charging brush 20 encounter with a pinhole or a similar defect and thereby an abnormal current flows through the brush hairs, the level thereof is detected by the detector 205, and a comparator 207 compares the detected value with a reference voltage supplied from a comparison reference voltage generator 206. When the detected value exceeds the reference voltage, this fact is informed to a hold part 208, whereby the hold part 208 turns off the transistor Tr to stop generation of signal by the signal generating circuit 203, by which the high voltage generating operation is stopped. Thus, the voltage supplied to the charging brush 20 is lowered to 0 V.

The reference voltage of the reference voltage generator 206 is set at a value corresponding to the upper limit current (limit current) which can be considered as a limit of the current flowing through the charging brush 20 which may cause inflammation of brush.

Figure 5:
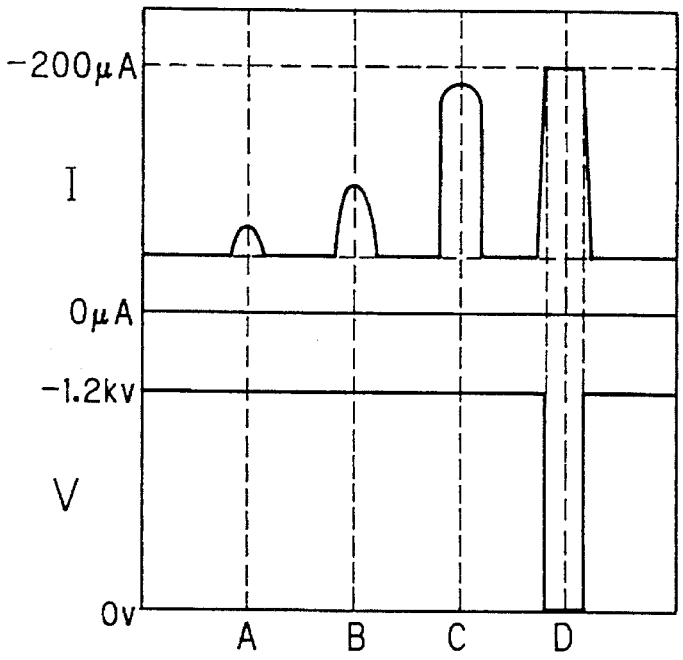
FIG. 5 is a graph showing a relationship between a supplied voltage (V) and a current (I) according to a circuit shown in FIG. 4.

FIG. 5 exemplifies a relationship between the supplied voltage (V) and the current (I). In the example shown in FIG. 5, the upper limit of the current is −200 μA. In this case, small pinholes A, B and C (A<B<C) do not cause the drop of the supplied voltage to 0 V, so that the surface of the photosensitive drum 1 can be uniformly charged by the constant voltage, and thus the image forming operation can be continued. Meanwhile, the unacceptably large pinhole D (C<D) causes the current to exceed −200 μA, so that the supplied voltage drops to 0 V. In connection with this, there may be provided means for warning the abnormal state to a user, alarm means, e.g., for turning on and off an LED, alarm means for displaying the abnormal state on a liquid crystal display and/or means for stopping the image forming operation, and further there may be provided means for displaying a message for calling a service man after the stop.

Figure 6:
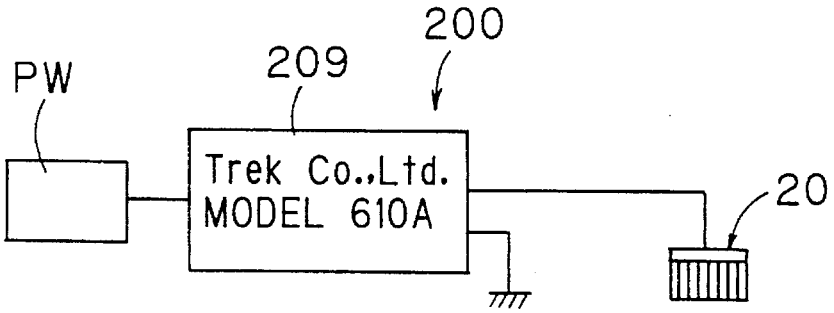
FIG. 6 is a block diagram showing another example of a current upper limiter.
Figure 7:
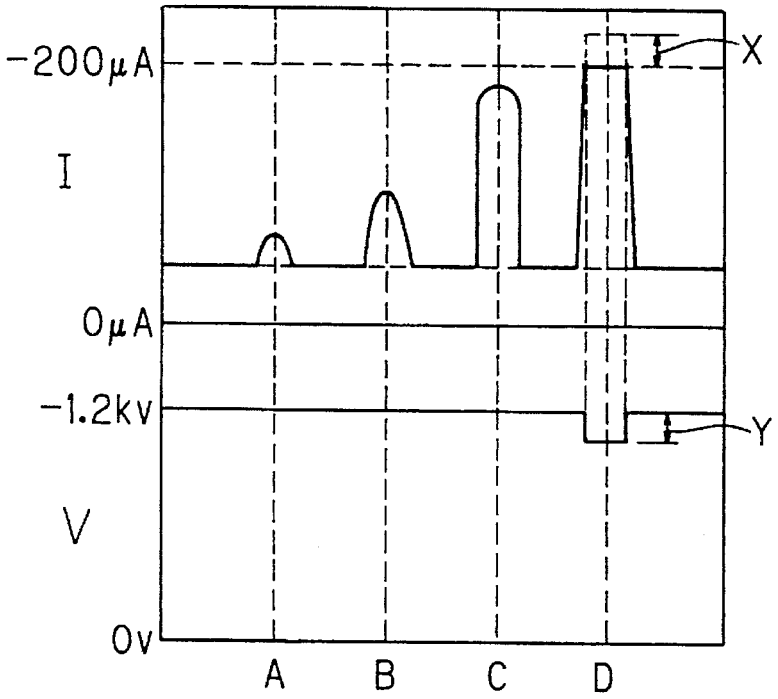
FIG. 7 is a graph showing a relationship between a supplied voltage (V) and a current (I) according to a current upper limiter shown in FIG. 6.

In another example, the controller 200 may be formed of MODEL 610A manufactured by Trek Co., Ltd., as shown in FIG. 6. In the case where the upper limit current (limit current) is set at −200 μA, this device lowers the supplied voltage by Y for lowering the current by an excessive value X, by which the current tends to exceed the limit current due to the encounter of the brush portion 20 of the charging device 2 with the unacceptable pinhole D, as shown in FIG. 7. According to this device, the supply of voltage to the charging device 2 is maintained even if the pinhole D exists, and thus the image forming operation can be continued. Also in this case, there may be provided means for stopping the image forming operation when the abnormal current is of an excessively large value, means for displaying a message for calling a service man after the stop, and other alarm means.

Inflammability of the brush was evaluated in such a manner that a pinhole of 600 μm in diameter was formed in the photosensitive layer of the photosensitive drum 1, and the surface of this photosensitive drum 1 was charged by the charging device 2.

For this evaluation, various limit current values (μA) were used. The brush hairs 21 forming the brush part 20 are of 6 deniers, are 5 mm in length and has the electrical resistivity of about $1\times10^6$ Ωcm, as described before.

In the evaluation, tip ends of the charging brush hairs corresponding to the pinhole in the photosensitive drum 1 was inspected, and was determined that it had "burnt" if the tip ends were shortened from the initial length. It was also determined that the hairs had burnt, if spread of burnt portion or smoke was recognized.

Result of evaluation is shown in Table 1. In Table 1 in which "Em." represents "example", and "EmF." represents "example for comparison", all the examples 1–5 employ the current upper limiter shown in FIG. 4. In the column of inflammability, "O (circle)" mark indicates "no inflammation", and "X" mark indicates "inflammation". In the total evaluation column, which indicates the result of total evaluation, "O" mark indicates an acceptable state in which no abnormal state was recognized, and "X" mark indicates unacceptable state.

TABLE 1

| | Limit Current (μA) | Fiber Size (deniers) | Fiber Length (mm) | Fiber Resistance (Ωcm) | Inflammability | Total Evaluation |
|---|---|---|---|---|---|---|
| Em.1 | 20 | 6 | 5 | 1000000 | O | O |
| Em.2 | 30 | 6 | 5 | 1000000 | O | O |
| Em.3 | 50 | 6 | 5 | 1000000 | O | O |
| Em.4 | 100 | 6 | 5 | 1000000 | O | O |
| Em.5 | 200 | 6 | 5 | 1000000 | O | O |
| EmF. | >300 | 6 | 5 | 1000000 | X | X |

In addition to the foregoing experimental evaluation, such experiments were carried out that (1) the brush fibers forming the brush part 20 are of 10 deniers, (2) were 3 mm and 7 mm in length. Other conditions for these experiments were the same as those for the examples 1–5. In these experiments, no inflammation of brush part was recognized. From this, it can be confirmed that the inflammability does not depend on the size (thickness) and length of the fibers.

Still another experiments were carried out with the limit current value of −200 μA, which is the same as the example 5 in Table 1, under the conditions that the resistivities of the brush fibers were $10^4$, $10^5$, $10^7$, $10^8$ and $10^9$ Ωcm, respectively. In all the cases, no inflammation of brush part was recognized. Although the increase of the fiber resistance improves the inflammation proof, the fiber resistance of $10^8$ Ωcm or less is desirable in view of the chargeability.

The material of the charging member of the charging device according to the invention is not particularly restricted and can be selected from various materials which have appropriate electrical resistivity, flexibility, hardness, configuration and strength allowing a desired charged amount to be obtained by application of DC or AC voltage, or superimposition thereof, in view of the chargeability, surface hardness and diameter of the photosensitive drum as well as positional relationship to another elements, system speed and others. For example, the brush of the charging member may be metal wires of tungsten, stainless steel, gold, platinum, iron, copper, aluminium and others having appropriate length and/or diameter. The brush also may be formed of fiber and resistance adjusting agent dispersed therein. This fiber may be made of rayon, nylon, acetate, cuprammonium, vinylidene, vinylon, ethylene fluoride, promix, benzoate, polyurethane, polyester, polyethylene, polyvinyl chloride, polychlal, polynosic, polypropylene and others. The resistance adjusting agent may be carbon black, carbon fiber, metal powder, metal whiskers, metal oxide, semiconductor and others. In this case, a dispersed amount may be adjusted to obtain an intended resistance. Instead of dispersion in the fiber, the surface of the fiber may be covered with the resistance adjusting agent. Further, the surfaces of electrically conductive fibers may be covered with insulating resin material, which usually has an electrical volume resistivity of about $10^8$ Ωcm or less in order to obtain a good charging performance. The section of the fiber may be appropriately selected from various shapes such as circular, ellipse, corrugated circle, polygon, flat shape and others in view of manufacture thereof.

Figure 8:
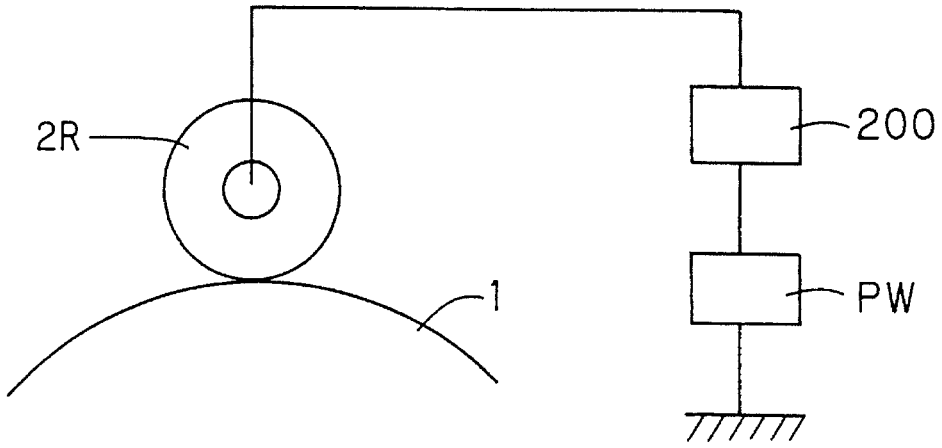
FIG. 8 shows a charging device of a second embodiment of the invention.
Figure 9:
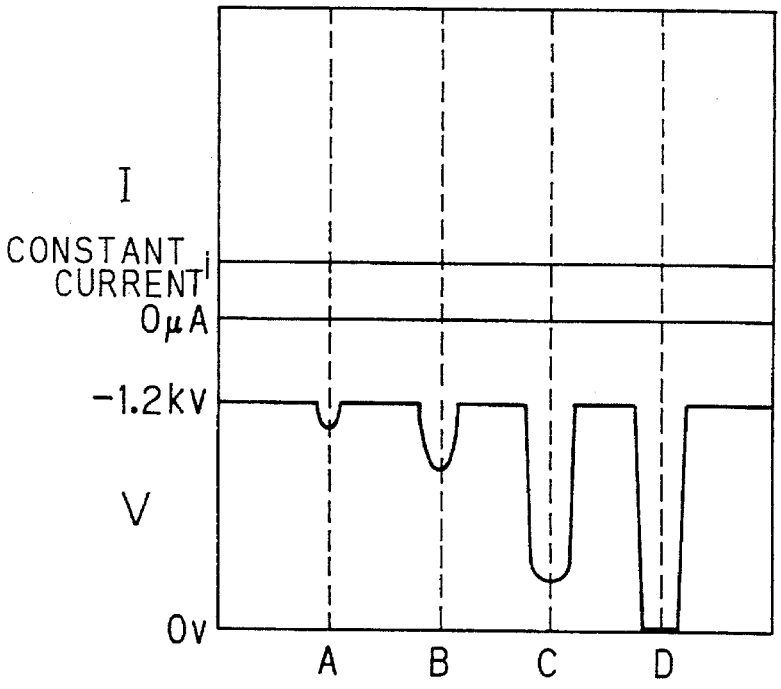
FIG. 9 (PRIOR ART)
FIG. 9 is a graph showing a relationship between a supplied voltage (V) and a current (I) according to a conventional constant current power supply.

Although in the specific embodiment described above, the charging member is a conductive brush of a fixed type, it may be a rotary brush of a roller type or may be of other forms such as roller 2R as shown in FIG. 8, blade, belt, film or cloth, which can be selected in view of the specification and form of the contact charging device.

In all the configurations and materials described above, such contact charging device can be obtained that a constant voltage is applied to the charging member, and the voltage applied to the charging means is lowered when the current flowing from the charging means to the photosensitive member exceeds the reference value, whereby it can prevent inflammation of the charging member and spread of fire by preventing generation of an excessively abnormal current and can charge the surface of the photosensitive member to have a uniform potential, even if the defect such as a pinhole exists in the surface of the photosensitive member.

The present invention is particularly effective in the case where the charging member is made of relatively inflammable material such as rayon.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A charging device comprising:

charging means having a charging member including a brush hair which is made of polymer materials and is provided in contact with or minutely spaced from a surface of a photosensitive member for charging said surface of said photosensitive member to have a predetermined potential, said brush hair having an electrical resistivity of $10^9$ Ωcm or less;

means for applying a constant voltage to said charging means; and control means for controlling the voltage applied by said applying means when a current flowing from said charging means to said photosensitive member exceeds a predetermined value.

2. A charging device according to claim 1, wherein a minute space between said charging member and said surface of said photosensitive member is 1500 μm or less.

3. A charging device according to claim 1, wherein said charging member is of a roller form.

4. A charging device according to claim 1, wherein said charging member includes brush hairs made of rayon fibers.

5. A charging device comprising:

charging means having a charging member which is made of polymer materials and is provided in contact with or minutely spaced from a surface of a photosensitive member for charging said surface of said photosensitive member to have a predetermined potential;

means for applying a constant voltage to said charging means;

means for detecting a current flowing through said charging means; and control means for comparing a detected value of said detecting means with a preset reference value and lowering the voltage applied by said applying means to 0 V when the detected value is larger than the reference value.

6. A charging device according to claim 5, wherein said control means has alarm means for alarming the fact that the current flowing through said charging means reaches the preset reference value.

7. A charging device according to claim 5, wherein said charging means includes a charging member made of rayon fibers.

8. A charging device according to claim 7, wherein said charging member is of a brush form.

9. A charging device according to claim 7, wherein said charging member is of a roller form.

10. A charging device comprising:

charging means having a charging brush which is provided in contact with or minutely spaced from a surface of a photosensitive member for charging said surface of said photosensitive member to have a predetermined potential;

means for applying a constant voltage to said charging means; and control means for lowering the voltage applied by said applying means to 0 V when a current flowing from said charging means to said photosensitive member exceeds a predetermined value.

11. A charging device according to claim 10, wherein a minute space between said charging brush and said surface of said photosensitive member is 1500 μm or less.

12. A charging device according to claim 10, further comprising means for detecting a current flowing through said charging means.

13. A charging device according to claim 10, wherein said charging brush includes brush hairs made of metal wires.

14. A charging device comprising:

charging means for charging a surface of a photosensitive member to have a predetermined potential;

applying means for applying a voltage to said charging means;

detecting means for detecting a current flowing through said charging means; and control means for comparing a detected value of said detecting means with a preset reference value and lowering the voltage applied by said applying means so that a current value may be lowered by an amount corresponding to a difference between the detected value and the reference value when an abnormal current flowing from said charging means to said photosensitive member is detected by said detecting means.

15. A charging device as claimed in claim 13, wherein said control means lowers the voltage applied by the applying means at 0 V.

16. A charging device as claimed in claim 13, wherein said applying means applies a constant voltage to the charging means.

17. A charging device as claimed in claim 13, wherein said charging means has a charging member which is made of polymer materials and is provided in contact with or minutely spaced from the surface of the photosensitive member.

18. A charging device comprising:

charging means having a charging member for charging a surface of a photosensitive member to have a predetermined potential;

means for applying a constant voltage to said charging means;

means for detecting a current flowing through said charging means; and control means for comparing a detected value of said detecting means with a preset reference value and lowering the voltage applied by said applying means so that a current value may be lowered by an amount corresponding to a difference between the detected value and the reference value when the detected value is larger than the reference value.

19. A charging device comprising:

charging means having a charging member for charging a surface of a photosensitive member to have a predetermined potential;

means for applying a constant voltage to said charging means;

means for detecting a current flowing through said charging mean; and control means for comparing a detected value of said detecting means with a preset reference value and lowering the voltage applied by said applying means when the detected value is larger than the reference value, said control means having alarm means for signaling when the current flowing through said charging means reaches the preset reference value.

* * * * *